US005974276A

United States Patent [19]

Oogi

[11] Patent Number: 5,974,276

[45] Date of Patent: Oct. 26, 1999

[54] IMAGE DENSITY ADJUSTMENT METHOD FOR IMAGE FORMING APPARATUS

[75] Inventor: Syuji Oogi, Toyohashi, Japan

[73] Assignee: Minolta Co., Ltd., Osaka, Japan

[21] Appl. No.: 09/017,054

[22] Filed: Jan. 27, 1998

[30] Foreign Application Priority Data

Jan. 28, 1997 [JP] Japan ..... 9-014321

[51] Int. Cl.[6] ..... G03G 15/00

[52] U.S. Cl. ..... 399/46; 399/43; 399/49; 399/50

[58] Field of Search ..... 399/26, 43, 46, 399/48, 49, 50, 168; 430/902

[56] References Cited

U.S. PATENT DOCUMENTS

| | | | |
|---|---|---|---|
| 4,468,112 | 8/1984 | Suzuki et al. . | |
| 4,879,576 | 11/1989 | Naito . | |
| 4,962,407 | 10/1990 | Ueda . | |
| 5,006,896 | 4/1991 | Koichi et al. . | |
| 5,146,269 | 9/1992 | Shimizu et al. . | |
| 5,223,896 | 6/1993 | Shimizu et al. | 399/46 |
| 5,729,786 | 3/1998 | Yamada et al. | 399/49 X |

FOREIGN PATENT DOCUMENTS

| | | |
|---|---|---|
| 58-221869 | 12/1983 | Japan . |
| 3-13585 | 2/1991 | Japan . |
| 6-64384 | 8/1994 | Japan . |

*Primary Examiner*—Arthur T. Grimley
*Assistant Examiner*—Sophia S. Chen
*Attorney, Agent, or Firm*—McDermott, Will & Emery

[57] ABSTRACT

The present invention, for example, forms a test pattern image on the surface of a photosensitive member at predetermined periodicity and detects the density of said test pattern image. If the detected density value of the test pattern image is other than said target value, the charging voltage is preferentially adjusted to maintain a stable toner density. When the adjusted charging voltage attains either an upper limit or a lower limit, the toner density is adjusted.

28 Claims, 8 Drawing Sheets

IMAGE DENSITY ADJUSTMENT METHOD FOR IMAGE FORMING APPARATUS

This application is based on application No. 9-14321 filed in Japan, the content of which is hereby incorporated by reference.

BACKGROUND OF THE INVENTION

1. Field of the Invention

The present invention relates to an image density adjustment method for image forming apparatus of the electrophotographic type.

2. Description of the Related Art

In conventional copiers and printers of the electrophotographic type, a test pattern image of constant area is formed on the surface of a photosensitive drum and the density of this test pattern image is optically detected, and the charge voltage of the photosensitive member, developing bias voltage, and amount of optical exposure is changed in accordance with said detected density value so as to maintain an optimum image density. This control is based on changing the optimum image forming conditions to maintain a constant image density by changing the environmental conditions which to compensate for fatigue of the photosensitive member and developer (carrier) over time. Developer is particularly susceptible to fluctuation of environmental conditions and developing capability is markedly reduced under conditions of high temperature and high humidity. Since image density is naturally reduced if developing capability is reduced, the charge voltage or toner density must be increased.

When adjustment of the charge voltage of the photosensitive member and adjustment of the toner density are compared, it can be understood that adjustment of the charging voltage is advantageous inasmuch as it provides excellent responsiveness to image density, but is disadvantageous insofar as optical exposure becomes inadequate due to the decrease in potential of the background area of the photosensitive member in conjunction with the increase in charging voltage. Optical exposure cannot be set too high from the perspectives of additional power consumption of the lamp, temperature elevation, and service life of the lamp and photosensitive member. On the other hand, whereas adjustment of toner density does not produce the aforesaid disadvantage of inadequate optical exposure, it is nevertheless disadvantageous in that responsiveness to image density is delayed because the toner density changes only gradually, and when toner density is increased beyond necessity, toner adheres to non-image regions and causes image noise.

SUMMARY OF THE INVENTION

An object of the present invention is to provide an image density adjustment method which eliminates the aforesaid disadvantages, and provides mutual advantages of effectively combining the aforesaid photosensitive member charging voltage adjustment method and toner density adjustment method which possess conflicting advantages and disadvantages.

The present invention attains the aforesaid objects by providing an image density adjustment method for image forming apparatus which detects condition data relating to the condition of a photosensitive member, compares said condition data with preset values and adjusts the photosensitive member charging voltage based on the result of said comparison when a toner density is a standard value, and adjusts toner density set for an upper limit or lower limit of charging voltage when the adjusted charging voltage attains either an upper limit or lower limit.

The present invention, for example, forms a test pattern image on the surface of a photosensitive member at predetermined periodicity (e.g., after a predetermined number of sheets), and detects the density of said test pattern image. If the detected density value coincides with a preset target value, the image forming process continues with the photosensitive member charging voltage and toner density values set at that time. On the other hand, when the detected density value of the test pattern image is other than said target value, a determination is made as to whether or not said toner density is a standard value, and if said toner density is a standard value, the photosensitive member charging voltage is adjusted. That is, the charging voltage is preferentially adjusted to maintain a stable toner density. Therefore, image density is stabilized with excellent responsiveness. When the adjusted charging voltage attains either an upper limit or a lower limit, the toner density is adjusted with the charging voltage set at either said upper limit or lower limit. In this way side effects are prevented by having the charging voltage outside an optimal adjustment range.

For example, when the detected density value of a test pattern image is greater than said target value after the photosensitive member charging voltage has attained an upper limit value, the toner density can be reduced by conditionally adjusting said toner density within an allowed adjustment range. When toner density has been adjusted after the charging voltage has attained either an upper limit value or lower limit value and the adjusted toner density attains either an upper limit value or lower limit value, a warning is generated indicating adjustment is no possible. The toner density adjustment amount is suitably ±0.2~1.0% per cycle of the image density adjustment process.

Another image density adjustment method of the present invention detects condition data relating to changes in image density and adjusts a first adjustment item capable of multi-step adjustment in a single adjustment process based on said detected condition value, and adjusts a second adjustment item capable of only single-step adjustment in said single adjustment process based on said detected condition value. For example, charging voltage which has excellent responsiveness may be used as said first adjustment item, and toner density adjustment which does not have excellent responsiveness may be used as said second adjustment item.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

The preferred embodiments of the image density adjustment method of the present invention are described hereinafter with reference to the accompanying drawings.

Figure 1:
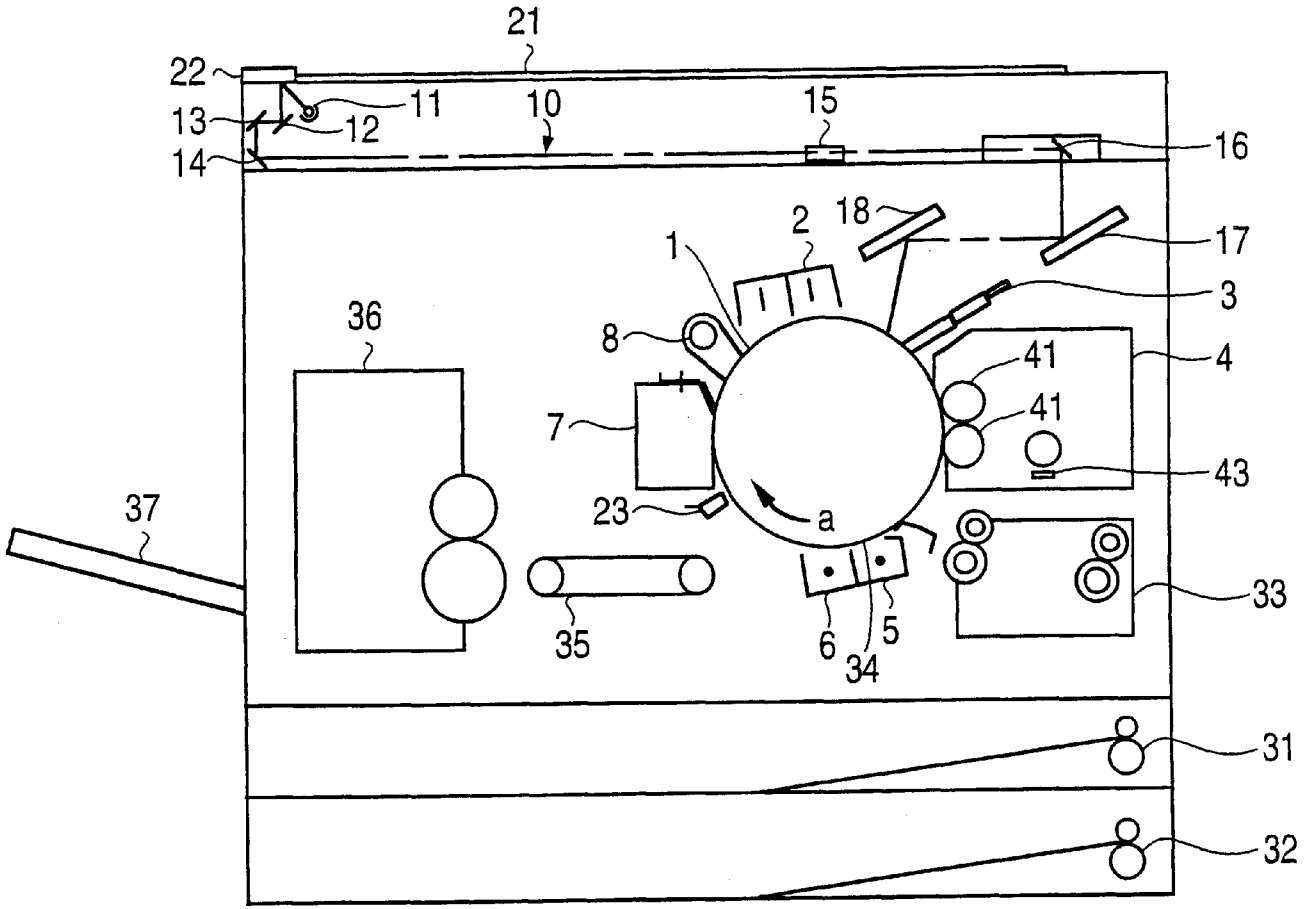
FIG. 1 briefly shows the construction of a copying apparatus using the image density adjustment method of the present invention.

FIG. 1 briefly shows the construction of a copying apparatus of the electrophotographic type.

This copying apparatus is provided with a centrally disposed photosensitive drum 1 which is driven in rotation in the arrow a direction, and arranged around the periphery of said photosensitive drum 1 in the direction of rotation are a charger 2, image interval/image edge eraser lamp 3, developing device 4, transfer charger 5, sheet separation charger 6, residual toner cleaner 7, and residual load eraser lamp 8. An image exposure optical unit 10 comprises an exposure lamp 11, mirrors 12, 13, 14, image forming lens 15, and mirrors 16, 17, and 18; the image of an original document placed on a document platen 21 is optically exposed on the surface of photosensitive drum 1 via image exposure optical unit 10. optical unit 10 and the various types of image forming elements are all well known components and description of said elements is therefore omitted herefrom.

The copying process is accomplished as described in brief below.

First, the surface of photosensitive drum 1 is uniformly charged by charger 2 and a document image is formed as an electrostatic latent image on said surface of drum 1 via optical unit 10 in conjunction with the rotation of photosensitive drum 1 in the arrow a direction. This electrostatic latent image is developed by toner in a developer said latent image passes the developing device 4 so as to be developed as a toner image. On the other hand, paper sheets are fed one sheet at a time from either paper cassettes 31 or 32, and said sheet passes through transport unit 33 so as to arrive at transfer region 34 synchronously with the toner image. In transfer region 34, the toner image is transferred to the sheet via a discharge by transfer charger 5, and the sheet is directly separated from photosensitive drum 1 via an alternating current (AC) discharge from separation charger 6. After transfer and separation, the sheet is transported to a fixing device 36 via an air suction belt 35, whereupon the toner is heated and fused to said sheet which is subsequently ejected to a tray 37 outside the apparatus. Thereafter, photosensitive drum 1 continues to rotate in the arrow a direction, and residual toner is removed by the drum surface via cleaner 7, and the residual charge is removed from the drum surface via eraser lamp 8 in preparation for a subsequent copy operation.

Figure 2:
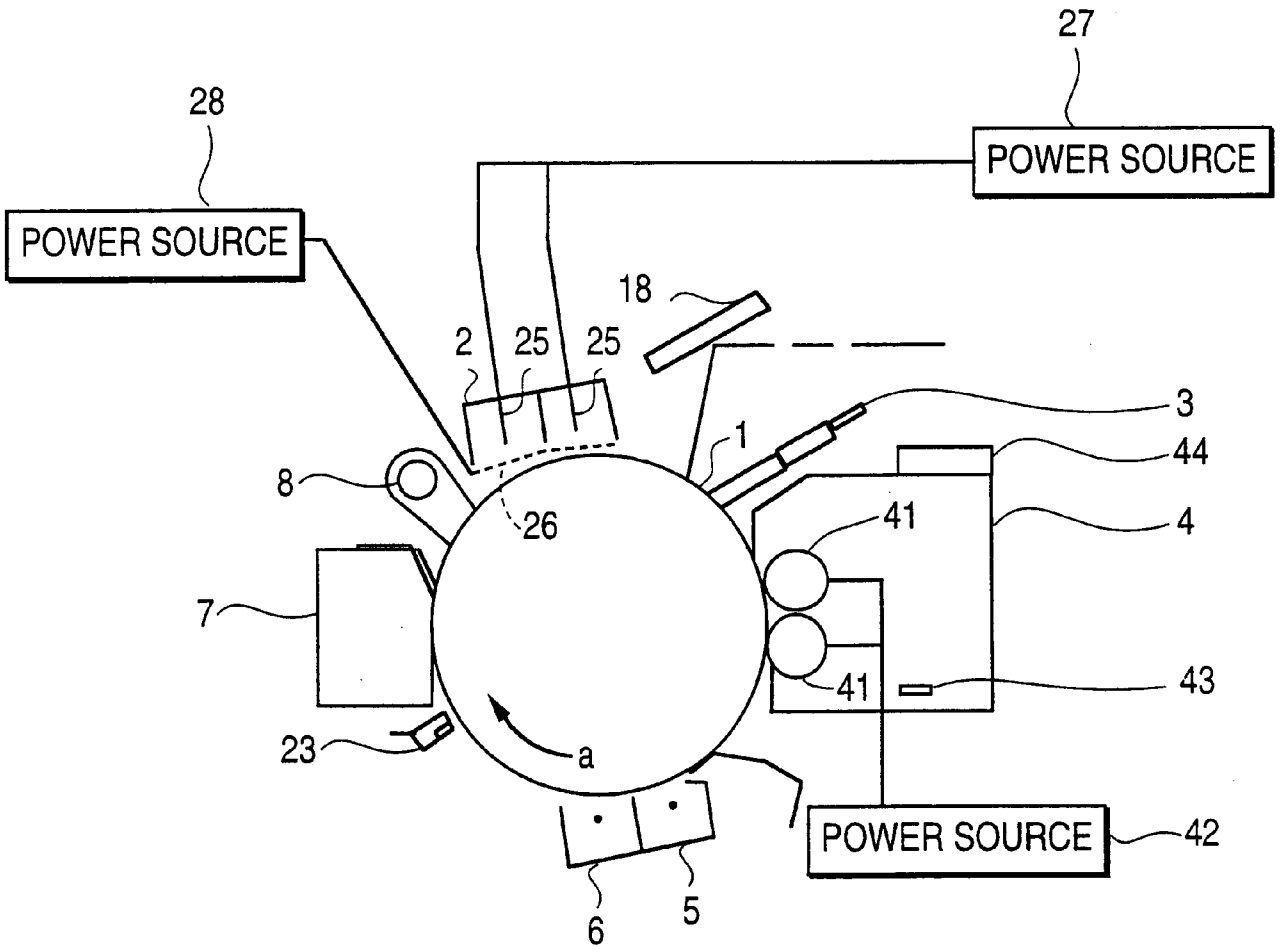
FIG. 2 shows the construction of the image forming unit of said copying apparatus.

FIG. 2 shows details of the image forming elements.

Charger 2 is a scorotron type charger provided with a mesh-like grid 26. A constant high voltage is applied to discharge wire 25 from a power source 27, and a voltage equivalent to the photosensitive member charging voltage is applied to grid 26 from a power source 28. Developing device 4 develops electrostatic latent images using two developing rollers 41; a developing bias voltage of predetermined value is applied to said two developing rollers 41 from a power source 42. A magnetic sensor 43 is provided in a developer tank to detect the toner density in the developer, and when the detected value of toner concentration detected via said sensor 43 is less than a set toner density value, an appropriate amount of toner is resupplied from a toner hopper 44.

This copying apparatus executes an image density adjustment process by providing a test pattern 22 which is black in color and disposed at the leading edge of document platen 21, and providing an optical sensor 23 to detect the image density on the surface of photosensitive drum 1 directly anterior to cleaner 7. The image density adjustment process is executed when the adjustment process is selected by an operator or at completion of a copy which exceeds a predetermined number of copies.

The surface of photosensitive drum 1 is uniformly charged by charger 2, and the light reflected by test pattern 22 (in actuality, very slight reflected light) is exposed on the surface of said drum 1 to form a test pattern image (latent image) of predetermined area. Then, this latent image is developed by developing device 4 as a test pattern image (toner image), said test pattern image passes chargers 5 and 6 which have been turned OFF, and the density of the test pattern image is detected by said sensor 23 directly anterior to cleaner 7. When the detected density of the test pattern image is outside a preset target value, the grid voltage of charger 2 is changed and the photosensitive drum charging voltage is preferentially adjusted to maintain the image density at a target value. When the grid voltage adjustment attains an upper limit or lower limit, then the toner density is adjusted with the grid voltage set at said upper limit or lower limit.

Normally, the adjustment range of the grid voltage (charging voltage) in a copying apparatus is about 400~1,000 V, and the toner density adjustment range is about 3~15%. In this instance, the grid voltage is adjusted in single steps of about 50 V with 700 V as a standard value, and toner density is adjusted in single steps of 1.0% with 9.0% as a standard value. The adjustment ranges and standard values are set in accordance with the characteristics of the photosensitive member and the developer. The single step adjustments used to adjust toner density may be suitably set at ±0.2~1.0%.

Figure 4:
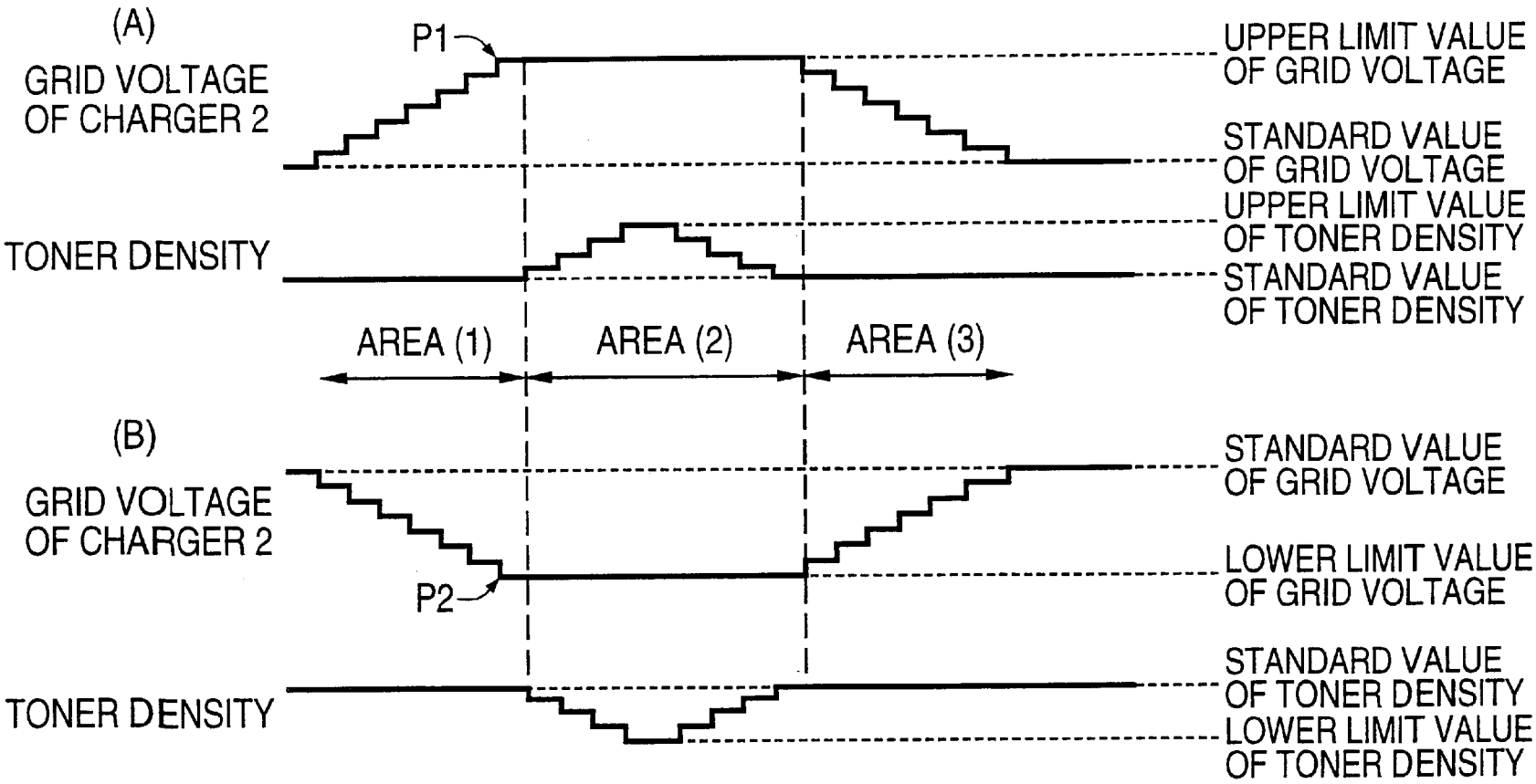
FIG. 4 is a chart showing the mode of the image density adjustment method of the present invention.

Adjustment of image density is accomplished when the detected density value of the aforesaid test pattern image density is outside a target value by first determining whether or not the current toner density is a standard value, and adjusting the toner density if said toner density is not a standard value. On the other hand, if the toner density is a standard value, the grid voltage is increased or decreased one step. In this instance, when the detected density value of the test pattern image is lower than a target value, the grid voltage is increased one step (refer to region (1) of FIG. 4A and region (3) of FIG. 4B), whereas when the detected density value is higher than said target value, the grid voltage is decreased one step (refer to region (3) of FIG. 4A, and region (1) of FIG. 4B). In this manner, a test pattern image is formed, and the grid voltage is adjusted as the density detection is repeated, and the adjustment process ends when the detected density of the test pattern image matches a target value. Therefore, image density can be stabilized with excellent responsiveness by adjusting the photosensitive member charging voltage through changing the grid voltage.

Upper and lower voltage limits are set because various side effects such as toner adhesion to the image background area are generated when the voltage becomes either too high or too low during adjustment of the grid voltage as previously described. Therefore, when the grid voltage attains either said upper limit value or lower limit value (refer to point P1 in FIG. 4A or point P2 in FIG. 4B), a single adjustment process is completed even when the detected density value of the test pattern image does not satisfy a target value. The copying apparatus, continues the copying process in this state, and if the grid voltage attains said upper limit value or lower limit value during the execution of the next adjustment process, the toner density is adjusted (refer to area (2) of FIGS. 4A, 4B) with the grid voltage set at either said upper limit value or lower limit value.

Toner density adjustment is accomplished by increasing the toner density one step when the detected density value of a test pattern image is lower than a target value, and decreasing said toner density one step when the detected density value is higher than said target value. That is, toner density adjustment is accomplished in single step increments during a single adjustment process because the responsiveness to image density is slower than adjustment than the aforesaid grid voltage adjustment. Toner replenishment in the developing device 4 is executed so as to match the adjusted toner density. An upper limit value and lower limit value are set for the toner density adjustment range because side effects such as inadequate toner charging may occur. Accordingly, when the grid voltage attains either an upper limit value or lower limit value by adjusting the grid voltage, and the toner density attains either an upper limit value or lower limit value by adjusting said toner density, the image density is not further adjusted, an indicator is displayed on the operation panel and a buzzer alarm is sounded.

Figure 3:
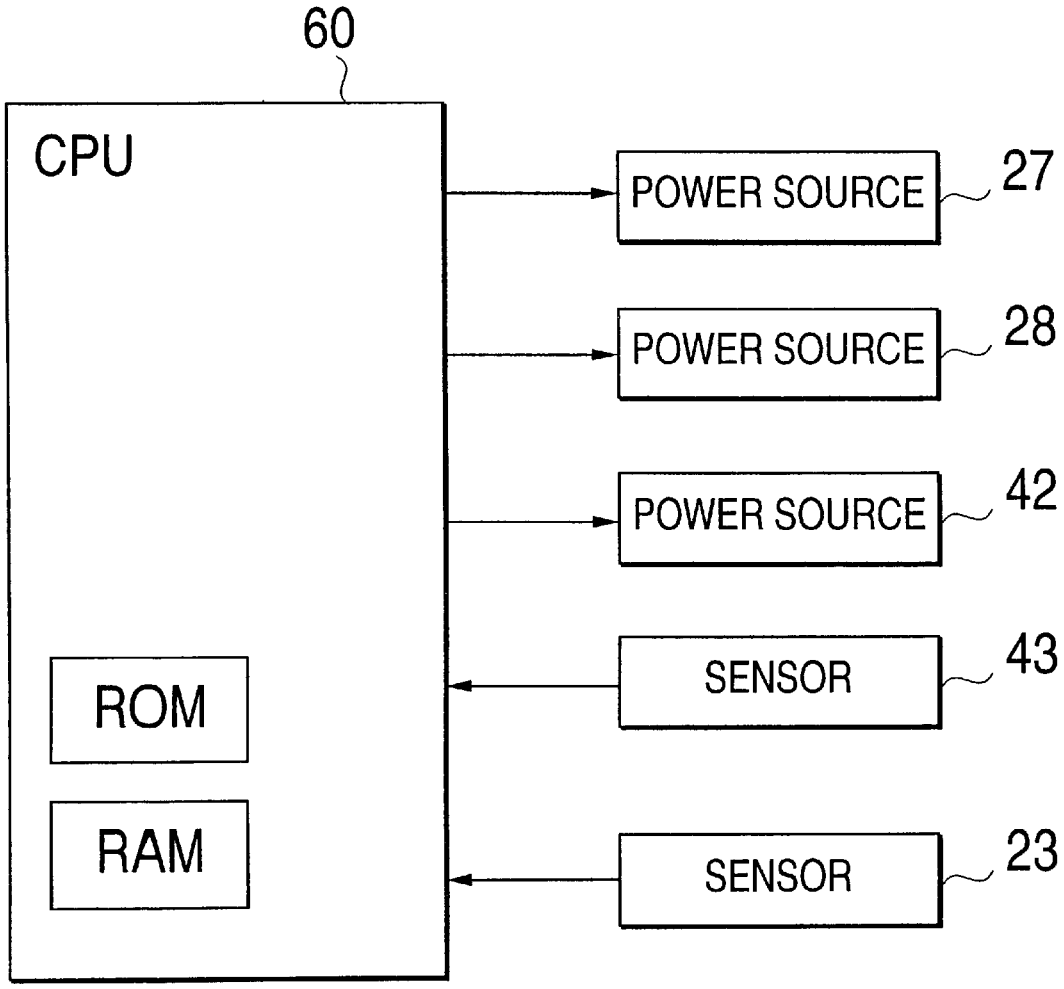
FIG. 3 is a block diagram showing the essential part of the control unit of said copying apparatus.

FIG. 3 shows the essential part of the control circuit of the copying apparatus.

Control is essentially executed by a central processing unit (CPU) 60; CPU 60 controls the ON/OFF switching of wire power source 27 and grid power source 28 of charger 2, and developing bias power source 42 of developing device 4 and the like, and specifically controls the output voltage value of grid power source 28. CPU 60 receives toner density detection signals of toner density in the developer from magnetic sensor 43, and density detection signals of the test pattern image from optical sensor 23. CPU 60 is internally provided with built in read only memory (ROM) to store programs and random access memory (RAM) for storing parameters input from sensors 43 and 23 and the like. The image density adjustment process is executed in accordance with programs stored in ROM.

First Embodiment

Figure 5:
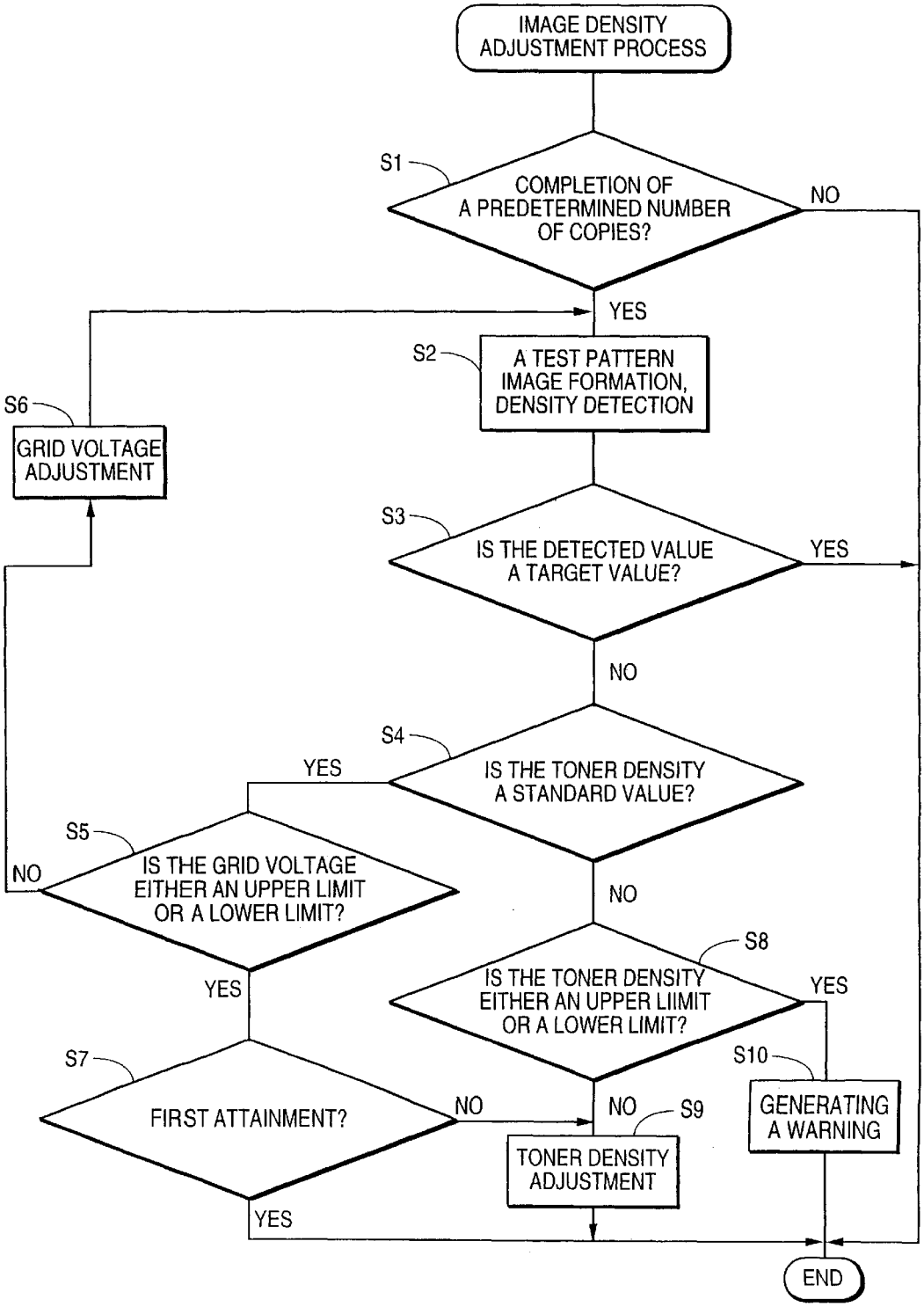
FIG. 5 is a flow chart showing a first embodiment of a control sequence of the image density adjustment method of the present invention.

FIG. 5 shows a first embodiment of the control sequence of the image density adjustment process.

First, in step S1, a check is made to determine whether or not copying of a predetermined number of sheets has been completed. When a predetermined number of copies has been completed (i.e., after completion of a series of copies in a multi-copy process) the following steps are executed.

In step S2, a test pattern image is formed and its density is detected, and in step S3, a determination is made as to whether or not the detected density value matches a target value. If the detected density value matches a target value, adjustment is unnecessary and this adjustment process ends. If the detected density value does not match a target value, a check is made in step S4 to determine whether or not the toner density is a standard value. If the toner density is a standard value, a check is made in step S5 to confirm the grid voltage is neither an upper limit value nor a lower limit value, and then the grid voltage is adjusted in step S6. In this instance, if the detected value is lower than a target value the grid voltage is increased one step, whereas if the detected value is higher than a target value, the grid voltage is decreased one step. Then, steps S2 and S3 are again executed, until the detected value matches a target value thereby accomplishing adjustment of the grid voltage. When the detected value matches a target value, this adjustment process ends.

In the grid voltage adjustment process, when the adjusted grid voltage attains either an upper limit value or lower limit value (step S5: YES), a check is made in step S7 to determine whether or not it is the first time said upper limit value or lower limit value has been attained. If it is the first time, the adjustment process ends. That is, the copying process is executed immediately with the current grid voltage only when the grid voltage first attains an upper limit value or lower limit value. In the next adjustment process, if the grid voltage attains an upper limit value or lower limit value (step S7: NO), the toner density is adjusted in step S9). In this instance, if the detected density of a test pattern image is lower than a target value, the toner density is increased one step, whereas if the detected density is higher than a target value, the toner density is decreased one step.

Thereafter, toner density adjustment is accomplished with the grid voltage set at either an upper limit value or lower limit value. That is, when it is determined in step S4 that the toner density is not a standard value and it is confirmed in step S8 that the toner density is an upper limit value or lower limit value, the toner density is adjusted in step S9. In this toner density adjustment process, when the adjusted toner density attains an upper limit value or lower limit value (step S8: YES), a warning is generated in step S10, and this adjustment process ends. The copying apparatus is capable of executing a copy process even though the aforesaid warning has been generated, but inspection and readjustment is then performed by service personnel.

Although a test pattern image is formed and the image density is detected and a determination is made as to whether or not the detected density value matches a target value in the first embodiment, a surface potential sensor may be provided to detect the surface potential of the photosensitive member so as to detect the potential of a latent image pattern formed on the surface of said photosensitive member and compare the detected surface potential with a target value.

Figure 7:
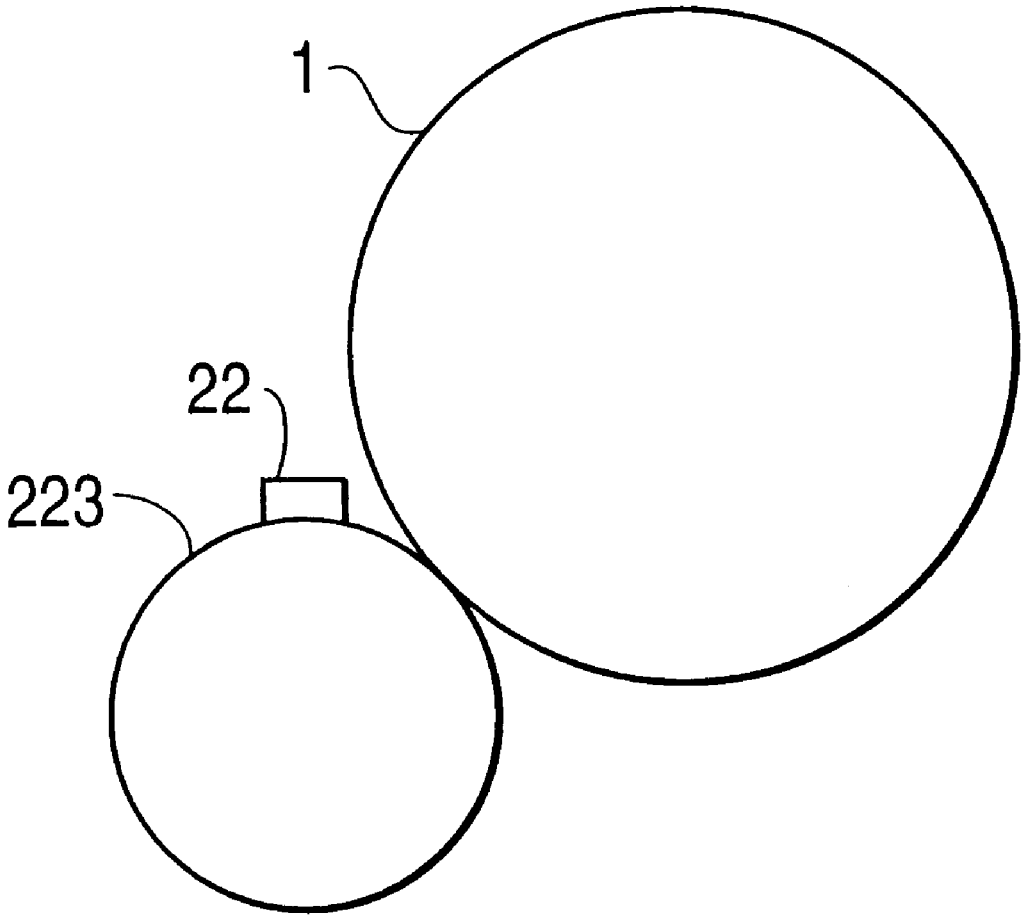
FIG. 7 is an illustration of using an intermediate transfer member for carrying a test pattern.
Figure 8:
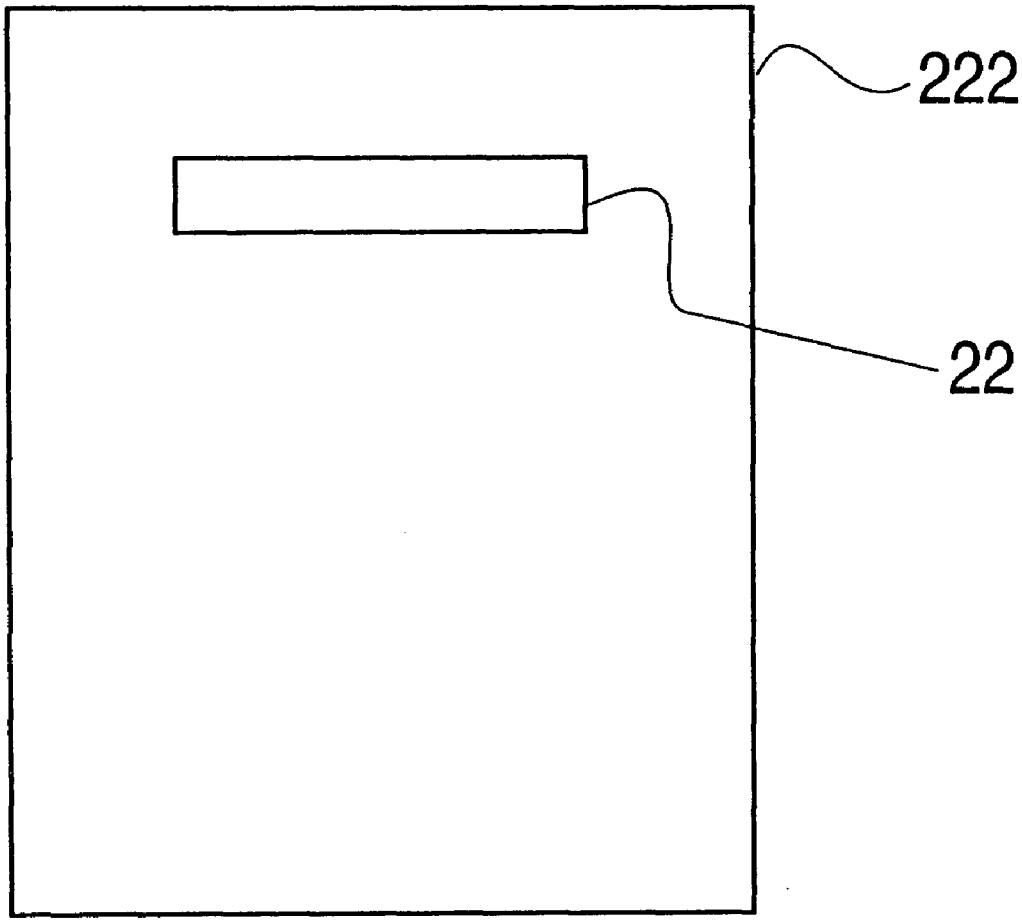

In the first embodiment, a test pattern image was formed on the surface of a photosensitive member and the image density was measured, but it is to be noted that a test pattern 22 may be formed on an intermediate transfer member 223 (i.e., a transfer drum or a transfer belt) so as to measure the density of said image as shown in FIG. 7. Similarly, a test pattern 22 image may be formed on a copy sheet 222 so as to measure the density of said image as shown in FIG. 8.

Second Embodiment

Figure 6:
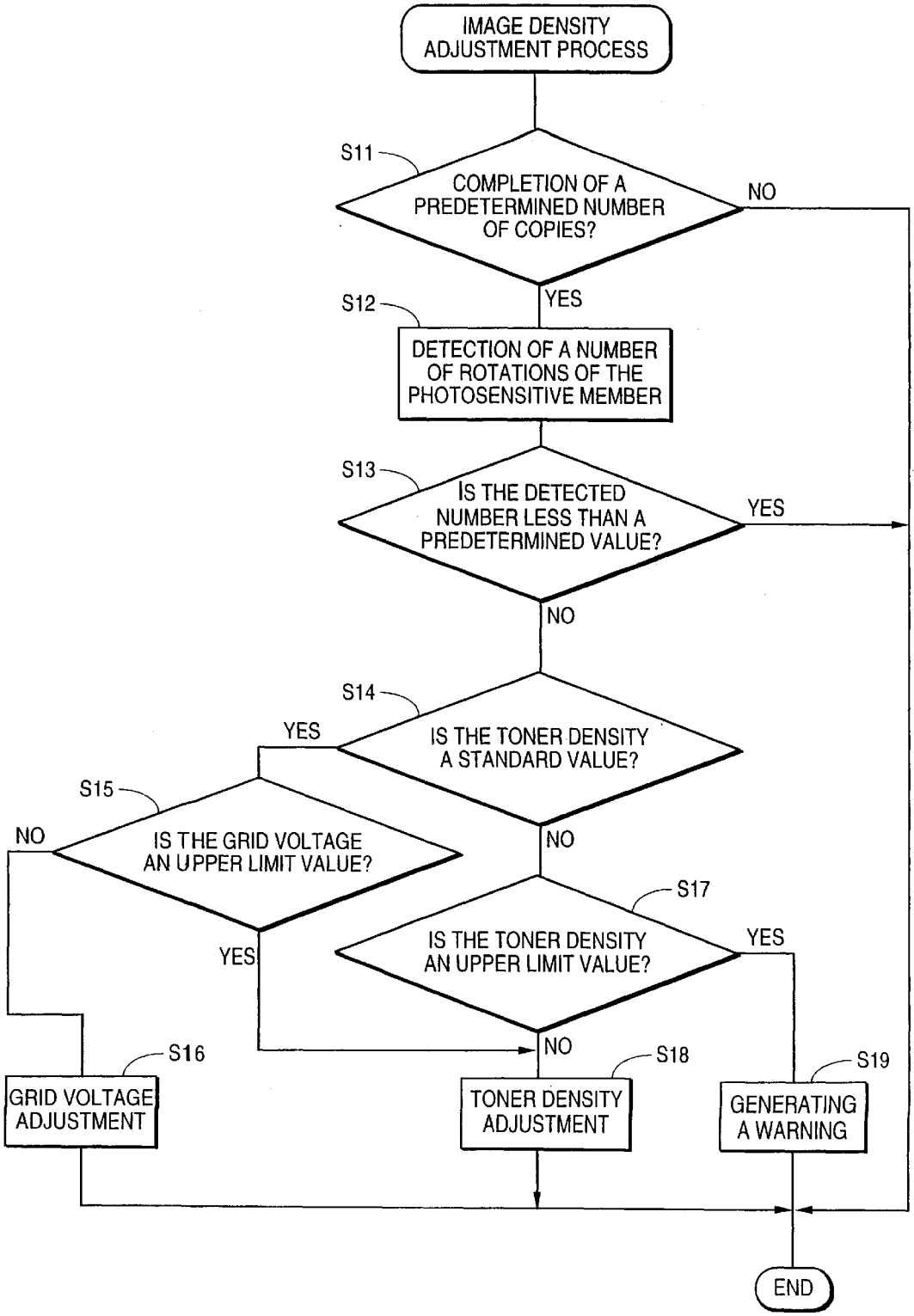
FIG. 6 is a flow chart showing a second embodiment of a control sequence of the image density adjustment method of the present invention.

FIG. 6 shows a second embodiment of the control sequence of the image density adjustment process.

The object of this embodiment is to prevent a reduction of image density in conjunction with fatigue of the photosensitive member occurring over time.

First, in step S11 a check is made to determine whether or not a predetermined number of copies have been completed. When a predetermined number of copies has been completed (i.e., after completion of a series of copies in a multi-copy process) the following steps are executed.

In step S12, the number of rotations of the photosensitive member is detected, and in step S13 a determination is made as to whether or not the detected number of rotations of the photosensitive member is less than a predetermined value. Adjustment is unnecessary if the detected number of rotations is less than a predetermined value, and this adjustment process ends. If the detected number of rotations of the photosensitive member is greater than said predetermined value, a check is made in step S14 to determine whether or not the toner density is a standard value. If the detected number of rotations exceeds said predetermined value, this number is cleared and the count starts again with the next detection. If the toner density is a standard value in step S14 and the grid voltage value is confirmed as not being an upper limit value in step S15, then the grid voltage is increased one step in step S16 and this adjustment process ends.

When the adjusted grid voltage attains an upper limit value (step S15: YES) in this grid adjustment process, toner density is increased one step in step S18.

Thereafter, the toner density is adjusted with the grid voltage set at said upper limit value. That is, insofar as toner density is determined as not being a standard value in step S14 and toner density is confirmed as not being an upper limit value in step S17, toner density is adjusted in step S18. When the adjusted toner density attains an upper limit value (step S17: YES) in this toner density adjustment process, a warning is generated in step S19 and this adjustment process ends.

Although a determination is made as to whether or not the detected number of rotations of the photosensitive member is less than a predetermined value in the second embodiment, it is to be noted that a cumulative number of rotations of the photosensitive member or cumulative rotation time of said photosensitive member may be detected instead of detecting the number of rotations of the photosensitive member.

The image density adjustment method of the present invention is not limited to the aforesaid embodiments, and naturally may be variously modified insofar as such modifications do not depart from the scope of the invention.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image density adjustment method for an image forming apparatus, comprising the steps of:

detecting condition data relating to a condition of a photosensitive member;

comparing the detected condition data with a preset value; and adjusting a photosensitive member charging voltage based on the result of said comparison when a toner density is a standard value, and adjusting the toner density set for an upper limit or lower limit of the photosensitive member charging voltage when the adjusted photosensitive member charging voltage attains either an upper limit or lower limit.

2. An image density adjustment method as claimed in claim 1, wherein said condition data is a detected density value of a test pattern image.

3. An image density adjustment method as claimed in claim 2, wherein said test pattern image is formed on a surface of the photosensitive member.

4. An image density adjustment method as claimed in claim 2, wherein said test pattern image is formed on a surface of an intermediate transfer member.

5. An image density adjustment method as claimed in claim 2, wherein said test pattern image is formed on a sheet.

6. An image density adjustment method as claimed in claim 1, wherein said condition data is a detected surface potential of the photosensitive member.

7. An image density adjustment method as claimed in claim 1, wherein said condition data is a number of rotations of the photosensitive member.

8. An image density adjustment method as claimed in claim 1, wherein said condition data is a cumulative number of rotations of the photosensitive member or cumulative rotation time of the photosensitive member.

9. An image density adjustment method as claimed in claim 1, further comprising the step of:

generating a warning when said adjusted toner density attains either an upper limit or a lower limit.

10. An image density adjustment method as claimed in claim 1, wherein the amount which the toner density is adjusted is ±0.2~1.0% per cycle of an image density adjustment.

11. An image density adjustment method as claimed in claim 1, wherein the photosensitive member charging voltage has an adjustment range of 400~1,000 V, and the toner density has an adjustment range of 3~15%.

12. An image density adjustment method as claimed in claim 1, wherein said toner density adjustment is accomplished in a single step adjustment during a single adjustment process.

13. An image density adjustment method as claimed in claim 1, wherein said image density adjustment method is executed when a predetermined number of image formations has been completed.

14. An image density adjustment method for an image forming apparatus, comprising the steps of:

detecting condition data relating to a condition of a photosensitive member;

comparing the detected condition data with a preset value; and adjusting a photosensitive member charging voltage based on the result of said comparison, and adjusting a toner density when the adjusted photosensitive member charging voltage attains either an upper limit or lower limit.

15. An image density adjustment method for an image forming apparatus, comprising the steps of:

forming a test pattern image on a surface of a photosensitive member;

detecting a density of the test pattern image; and adjusting a photosensitive member charging voltage, when the detected density is outside a preset target value, and adjusting a toner density set for an upper limit or lower limit of the charging voltage when the adjusted photosensitive member charging voltage attains either an upper limit or lower limit.

16. An image density adjustment method, comprising the steps of:

detecting condition data relating to changes in image density:

adjusting a first adjustment item by multi-step adjustment in a single adjustment process based on said detected condition data; and adjusting a second adjustment item by only single-step adjustment in the single adjustment process based on said detected condition data, wherein said first adjustment item has excellent responsiveness for image density, and wherein said second adjustment item does not have excellent responsiveness for image density.

17. An image density adjustment method as claimed in claim 16, wherein said first adjustment item is a charging voltage of a photosensitive member, and said second adjustment item is a toner density in a developing device.

18. An image forming apparatus, comprising:

a detector which detects condition data relating to the condition of a photosensitive member;

a comparator which compares the condition data with a preset value; and a controller which adjusts a photosensitive member charging voltage based on the result of said comparison when a toner density is a standard value, and which adjusts the toner density set for an upper limit or lower limit of the photosensitive member charging voltage when the adjusted photosensitive member charging voltage attains either an upper limit or lower limit.

19. An image forming apparatus as claimed in claim 18, wherein said condition data is a detected density value of a test pattern image.

20. An image forming apparatus as claimed in claim 19, wherein said test pattern image is formed on a surface of the photosensitive member.

21. An image forming apparatus as claimed in claim 18, wherein said condition data is a number of rotations of the photosensitive member.

22. An image forming apparatus as claimed in claim 18, further comprising:

a generator which generates a warning when said adjusted toner density attains either an upper limit or a lower limit.

23. An image forming apparatus as claimed in claim 18, wherein the amount which the toner density is adjusted is ±0.2~1.0% per cycle of an image density adjustment.

24. An image forming apparatus method as claimed in claim 18, wherein said toner density adjustment is accomplished in single step adjustment during a single adjustment process.

25. An image forming apparatus as claimed in claim 18, wherein said controller adjusts at least one of said photosensitive member charging voltage and said toner density when a predetermined number of image formations has been completed.

26. An image forming apparatus as claimed in claim 18, wherein said controller adjusts said photosensitive member charging voltage and said toner density based on machine executable instructions stored in a ROM.

27. An image forming apparatus as claimed in claim 26, wherein said controller carries out said machine executable instructions using parameters indicative of image density and toner density stored in a RAM.

28. An image forming apparatus as claimed in claim 18, wherein said controller adjusts said photosensitive member charging voltage and said toner density based on measured parameters indicative of image density and toner density stored in a RAM.

* * * * *